US009877097B2

(12) United States Patent
Saw et al.

(10) Patent No.: US 9,877,097 B2
(45) Date of Patent: Jan. 23, 2018

(54) SLIM-TUNNEL WIND PORT FOR A COMMUNICATION DEVICE

(71) Applicant: MOTOROLA SOLUTIONS, INC., Schaumburg, IL (US)

(72) Inventors: Teik Seng Saw, Kedah (MY); Cheah Heng Tan, Penang (MY); Huoy Thyng Yow, Penang (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 38 days.

(21) Appl. No.: 14/735,407

(22) Filed: Jun. 10, 2015

(65) Prior Publication Data

US 2016/0366505 A1 Dec. 15, 2016

(51) Int. Cl.
*H04R 1/08* (2006.01)

(52) U.S. Cl.
CPC ..... *H04R 1/086* (2013.01); *H04R 2410/07* (2013.01); *H04R 2499/11* (2013.01)

(58) Field of Classification Search
CPC .. H04R 1/086; H04R 2410/07; H04R 25/402; H04R 1/08; H04M 1/19
See application file for complete search history.

(56) References Cited

U.S. PATENT DOCUMENTS 5,276,916 A * 1/1994 Pawlish ..... H04M 1/0214 361/814
5,905,803 A 5/1999 Dou et al.
7,894,621 B2 * 2/2011 Jensen ..... H04R 1/086 381/322
7,916,887 B2 3/2011 Cleckler et al.
8,116,482 B2 2/2012 Cerwin et al.
8,208,673 B2 6/2012 Graham et al.
8,351,633 B2 1/2013 Lassally
2006/0034476 A1 2/2006 Glezerman

FOREIGN PATENT DOCUMENTS

JP H02-46100 2/1990

OTHER PUBLICATIONS

Combined Examination and Search Report from the United Kingdom Intellectual Property Office for Application No. GB1609167.0 dated Jun. 30, 2016 (4 pages).

* cited by examiner

*Primary Examiner* — Duc Nguyen
*Assistant Examiner* — Taunya McCarty
(74) *Attorney, Agent, or Firm* — Michael Best & Friedrich LLP

(57) ABSTRACT

A housing having a port for reducing wind-induced noise in a communication device. The housing includes a first channel, a second channel, and a ridge between the first and second channels. The housing further includes a tunnel extending through the ridge, which tunnel connects the first and second channels. The housing further includes a microphone port beneath the ridge, which microphone port is connected to the tunnel and connects the tunnel to a microphone cavity in the housing.

20 Claims, 7 Drawing Sheets

80

| | MIC PORT DESIGN | WIND NOISE, dB | | DEPTH/ THICKNESS, mm | FREQUENCY RESPONSE |
|---|---|---|---|---|---|
| | | AVERAGE | WORST CASE | | |
| 1 | CONVENTIONAL SINGLE PORT | 73 | 78 | 3.8 | FR FLATNESS WITHIN 6dB |
| 2 | TORTUOUS PATH | 65 | 69 | 8 | FR FLATNESS > 6dB => EE EQ REQUIRED |
| 3 | BIG FRONT VOLUME | 68 | 73 | 20 | FR FLATNESS > 6dB => EE EQ REQUIRED |
| 4 | SLIM TUNNEL PORT | 69.5 | 73 | 3.8 | FR FLATNESS WITHIN 4dB |

FIG. 8

SLIM-TUNNEL WIND PORT FOR A COMMUNICATION DEVICE

BACKGROUND OF THE INVENTION

Microphones convert sounds to electrical signals and are used with a variety of devices where voice communication is desired. Microphones may be used in or with portable two-way radios. For example, a microphone in a portable two-way radio (a first portable two-way radio) generates a speech signal which may be encoded by the portable two-way radio and then transmitted to another or second portable two-way radio. The second portable two-way radio receives the encoded signal and then decodes that signal. Likewise, the second portable two-way radio encodes and transmits speech signals to be received and decoded by the first portable two-way radio. When a speech signal of poor speech quality is encoded at the first portable two-way radio, the decoded speech output at the second portable two-way radio can be unintelligible. A poor speech signal can be caused by, among other things, wind-induced noise in the microphone.

Each of the portable two-way radios processes the decoded signal to produce sound from a speaker in the portable two-way radio, or from a speaker in a remote speaker microphone ("RSM") accessory attached to the portable two-way radio. In portable two-way radios and remote speaker microphones, the speaker is located beneath a speaker grille in the device. Users of portable two-way radios will often direct their speech responses to the source of the speech to which they are responding by speaking into the speaker grille. Accordingly, the microphone for the portable two-way radio is often located near the speaker grille, for example, in a cavity beneath the speaker grille. Sound waves from the user's speech reach the microphone through an opening located above the microphone, known as a microphone port. Wind-induced noise can be caused when a microphone with a conventional microphone port is used in windy conditions, and the wind passing over the surface of the microphone port causes the formation of discrete vortices in the vicinity of the microphone port. These vortices lead to turbulence, which creates noise. This wind-induced noise degrades the speech signal being picked up by the microphone, which ultimately degrades the intelligibility of the speech produced when the speech signal is decoded by the receiving portable two-way radio.

Microphone ports designed to reduce wind-induced noise, i.e., wind ports, are known, in general. Known wind ports include, for example, a recessed-opening microphone port, a tortuous path microphone port, and a big-front volume microphone port. Each of these known ports includes a microphone mounted in a housing, with a microphone port or ports to allow sound to reach the microphone. A conventional, recessed-opening microphone port includes a single opening recessed in the housing for the microphone. A tortuous path microphone port includes a microphone mounted near the edge of a speaker located beneath the housing, and a small path located near the edge of the speaker, connecting the microphone and the speaker grille area. Sound travels to the speaker grille, and then through the path to the microphone. A big-front volume microphone port includes one or more openings in the housing, positioned above a space that provides for a large (relative to the microphone) volume of air above the microphone. Some of these known wind port designs may create an uneven frequency response in the microphone over the voice band, and others require a large amount of space to implement.

Accordingly, there is a need for a slim-tunnel wind port for a communication device.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

FIG. 8 is a table comparing the frequency response, wind noise performance, and depth of a slim-tunnel wind port to other conventional microphone ports.

Figure 1:
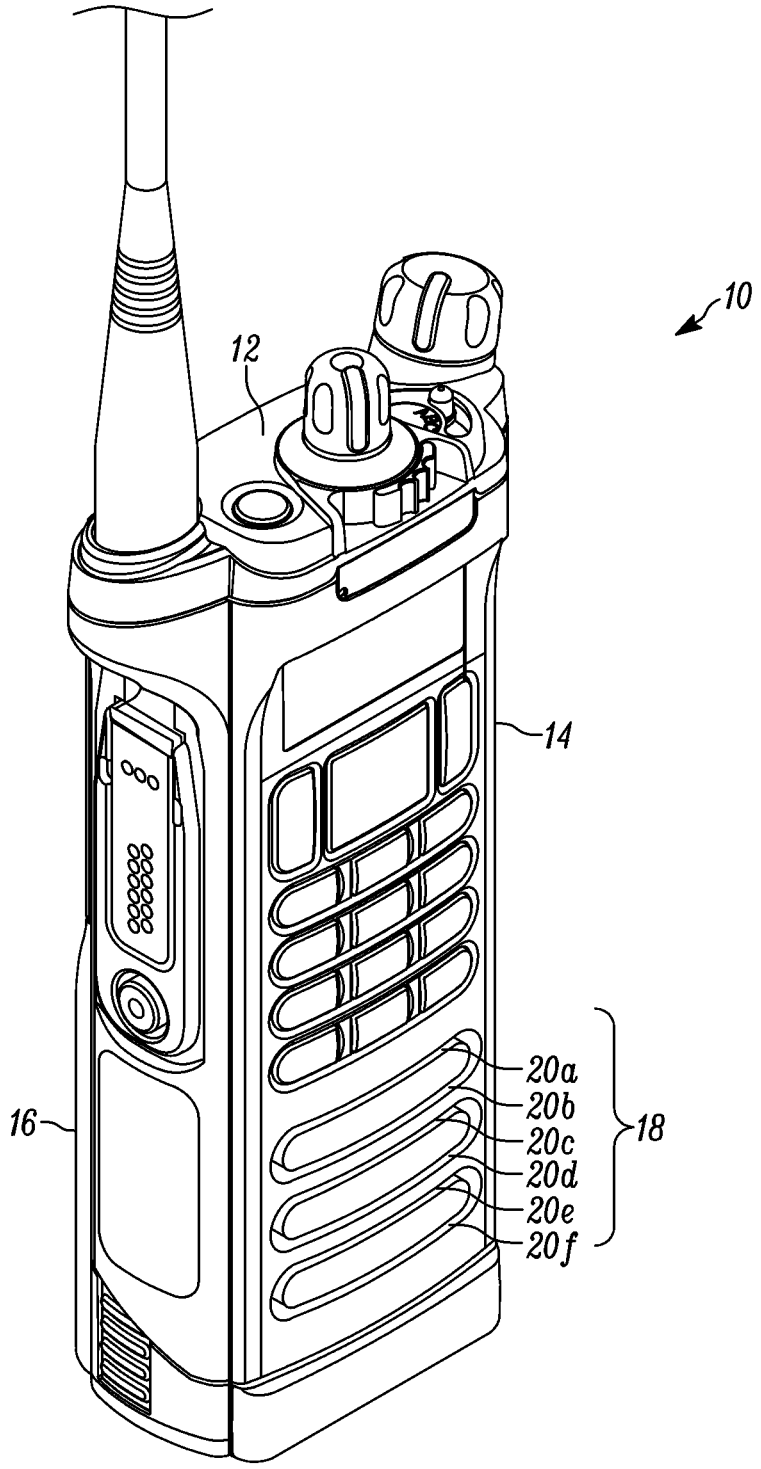
FIG. 1 is a perspective view of a communication device with a slim-tunnel wind port in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some exemplary embodiments include a housing for a communication device. In one embodiment, the housing includes a first channel, a second channel, and a ridge between the first and second channels. The housing further includes a tunnel extending through the ridge, which tunnel connects the first and second channels. The housing further includes a microphone port beneath the ridge, which port connects the tunnel to a microphone cavity in the housing.

FIG. 1 is a perspective view of a communication device 10 in accordance with one embodiment. The communication device 10 includes a housing 12. The housing 12 dimensionally can be described as having a top 14 and a bottom 16. In some embodiments, the housing 12 is manufactured from plastic using injection molding. In other embodiments, the housing 12 is manufactured using other suitable materials or methods. While the communication device 10, illustrated and described herein, is a portable two-way radio, it should be noted that in other embodiments, the communication device 10 could be a remote speaker microphone, a mobile telephone, or any electronic device that contains at least one microphone. It should also be noted that, in the specification and the claims, the terms "above," "below," "beneath," and the like are used in reference to the housing 12 as it lies horizontally. This is done for ease of description, and should not be considered limiting.

The top 14 of the housing 12 partially defines the speaker grille 18. The speaker grille 18 is further defined by a plurality of channels 20*a*-20*f*. Openings (not shown) in the housing 12 allow sound to emerge from the housing 12 through the speaker grille 18. In the illustrated construction, there are six channels 20*a*-20*f* that are substantially identical. In alternative embodiments, channels 20*a*-20*f* may vary in dimension and placement. Not all of the channels 20*a*-20*f* will be described in detail. It will be appreciated that the plurality of channels 20*a*-20*f* can be any quantity of channels; and the six shown are for illustrative purposes only.

Figure 2:
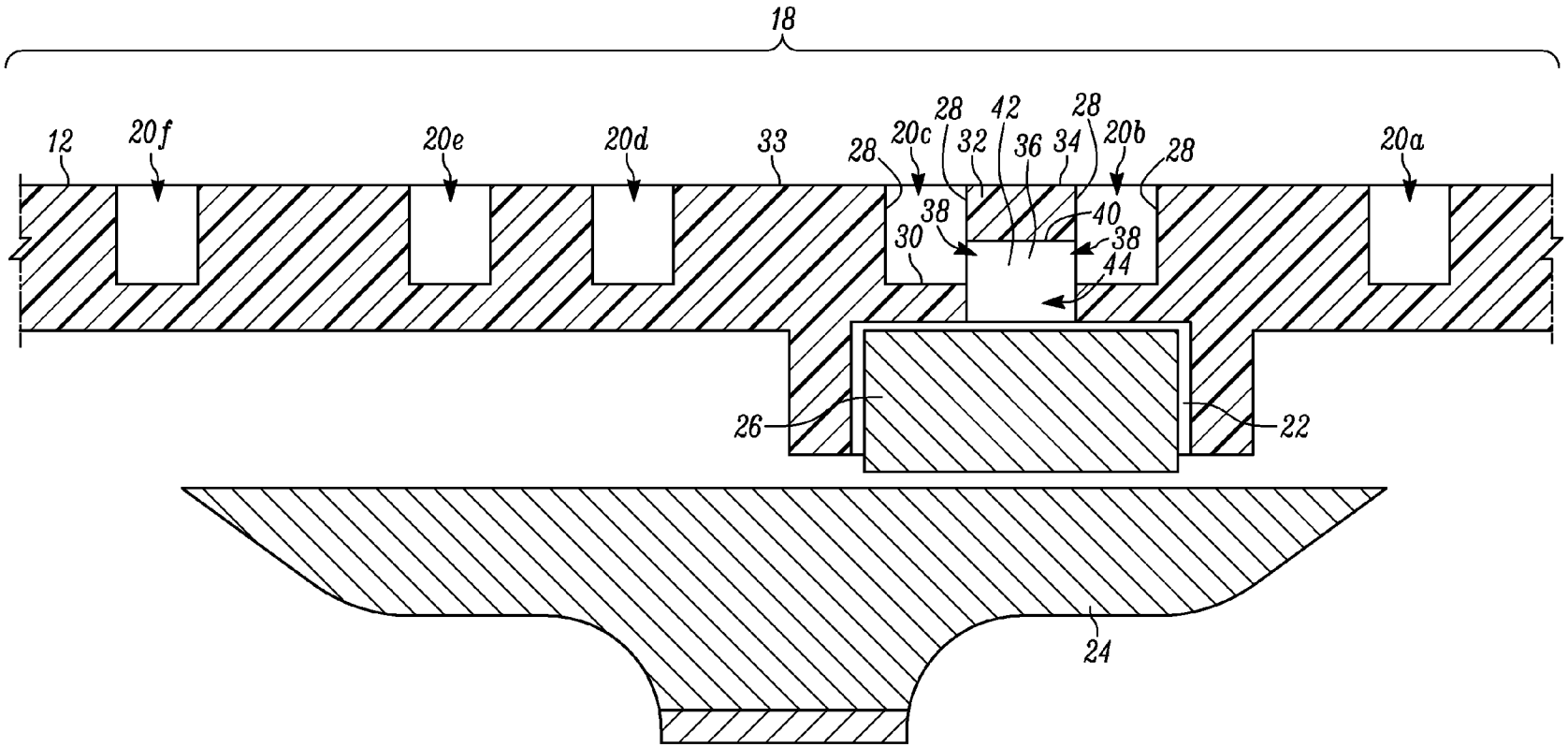
FIG. 2 is a cross sectional view of a portion of the communication device of FIG. 1

FIG. 2 is a cross sectional view of the housing 12. The housing 12 defines a microphone cavity 22. A speaker 24 is positioned inside the housing beneath the speaker grille 18, and a microphone 26 in the microphone cavity 22. The speaker 24 and the microphone 26 are conventional, and will not be described in greater detail.

As illustrated in FIG. 2, the channels 20*b*, 20*c* each have two vertical planar side walls 28 and a planar horizontal floor 30, which is perpendicular to the vertical side walls 28. In the embodiment illustrated, all of the channels 20*a-f* are parallel, but other configurations are possible within the scope of the invention. The vertical side walls 28 of adjacent channels 20*b*, 20*c* partially define a ridge 32, and a larger ridge 33.

The ridge 32 has a longitudinal axis, and is parallel to the channels 20*b*, 20*c*. As illustrated, in FIG. 1, the top 34 of the ridge 32 is slightly curved along its longitundinal axis, matching the overall slightly curved shape of the top 14 of the housing 12. In other embodiments, the top 34 of the ridge may be planar.

The housing 12 includes a tunnel 36 that extends through the ridge 32, and connects the channels 20*b*, 20*c* via the tunnel openings 38 in the vertical side walls 28 of the channels 20*b*, 20*c*. In other embodiments, the tunnel 36 could extend through the larger ridge 33. The tunnel openings 38 are rectangular. The tunnel 36 is perpendicular to the longitudinal axis of the ridge 32. A planar horizontal surface 40 of the ridge 32 defines the top of the tunnel 36. The ridge also has two vertical planar surfaces 42 that define the opposite sides of the tunnel 36. One of the vertical planar surfaces 42 is illustrated in FIG. 2. As illustrated, the tunnel 36 and tunnel openings 38 are rectangular, but other configurations are possible within the scope of the invention.

Also illustrated is a microphone port 44, which has a rectangular cross section, and extends downward from the bottom of the tunnel 36 into the microphone cavity 22, connecting the microphone cavity 22 with the tunnel 36. The microphone cavity 22 holds the microphone 26. When a user speaks into the communication device 10, the sound the user generates travels through the tunnel openings 38, into the tunnel 36, through the microphone port 44, into the microphone cavity 22, and to the microphone 26.

The multiple channels 20*a*-20*f*, the ridge 32, the larger ridge 33 of the housing 12, and the location of the tunnel openings 38 (below the surface of the speaker grille 18 and substantially perpendicular to the surface of the housing 12), disrupt the formation of turbulence-causing discrete vortices when air (e.g., wind) moves across the surface of the housing 12. When fewer discrete vortices are formed, less turbulence is caused, and less wind-induced noise results.

Furthermore, the illustrated design reduces the possibility of large particle intrusion into the microphone. The illustrated design also reduces the possibility of microphone abuse by the users or other people. For example, a person may try to poke a pin or paper clip into the microphone port 44 to damage the microphone 26. The multiple right-angles between the microphone 26 and the surface of the housing 12 make this sort of abuse difficult to accomplish.

Figure 3:
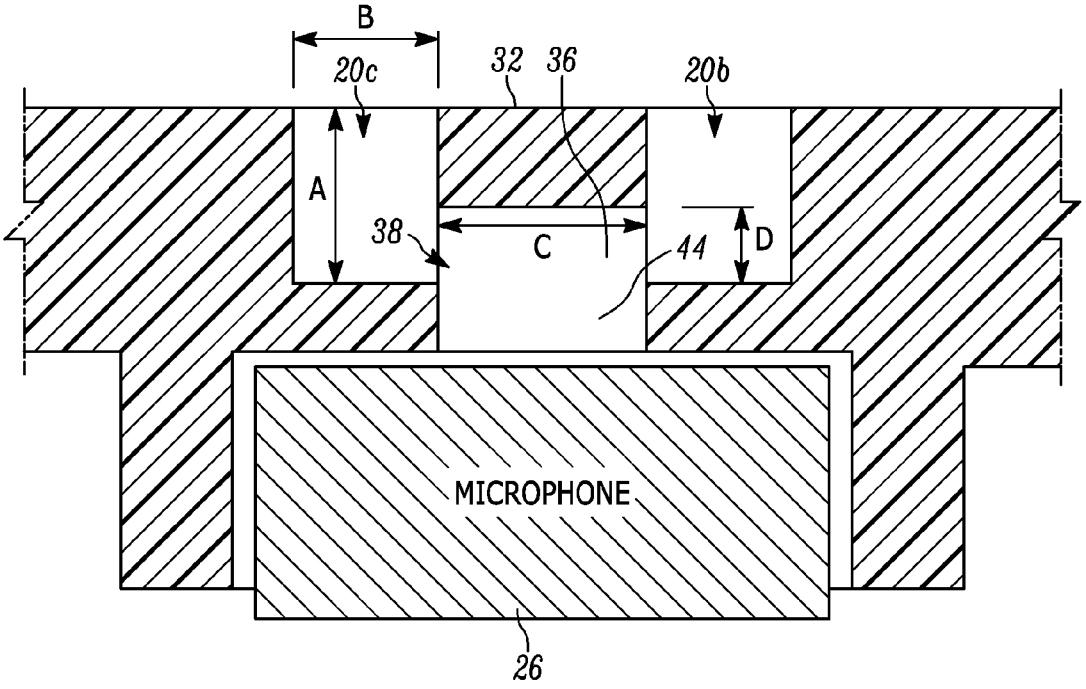
FIG. 3 is a cross sectional view of a slim-tunnel wind port and microphone in accordance with some embodiments.
Figure 4:
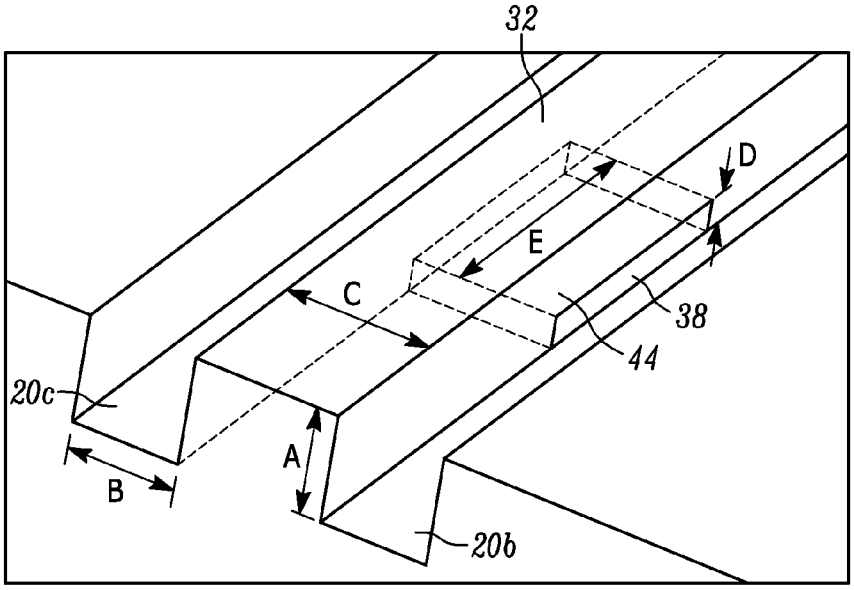
FIG. 4 is a perspective view of the slim-tunnel wind port of FIG. 3.

FIGS. 3 and 4 illustrate the approximate dimensions of one exemplary embodiment. The dimensions are generally governed by the size of the microphone 26, and scale nearly linearly with the size of the microphone 26. Generally, the tunnel 36 should fit within the footprint of the microphone 26. For example, the dimensions illustrated in FIGS. 3 and 4 may correspond to a microphone 26 having a six (6) millimeters footprint. One skilled in the art will appreciate that the dimensions listed herein are approximate and exemplary only, and the actual dimensions will vary from the approximations provided. With regard to the channels 20, the channel height A may be, for example, four (4) millimeters (mm), and the channel width B may be, for example, three (3) millimeters. The tunnel 36 length C, which is also the width of the ridge 32, may be, for example, four (4) millimeters. With regard to the tunnel openings 38, the tunnel opening height D may be, for example, two (2) millimeters. The tunnel opening 38 width E, which is also the width of the tunnel 36, may be, for example, four (4) millimeters. The perpendicular horizontal dimensions C and E of the tunnel 36 are substantially equal to the length and width of microphone port 44.

Figure 5:
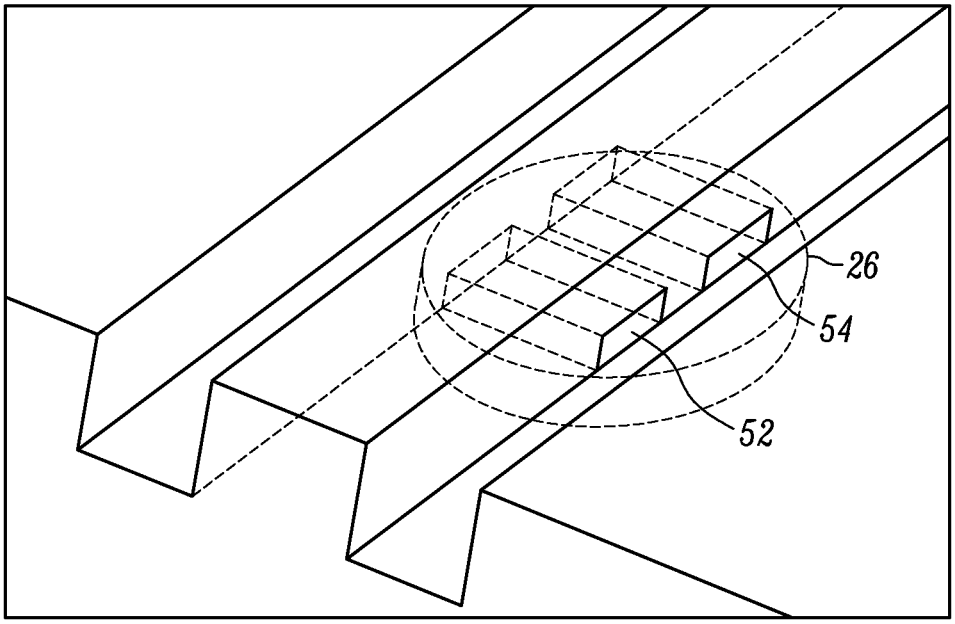
FIG. 5 is a perspective view of a dual-tunnel slim-tunnel wind port in accordance with some embodiments.

As illustrated in FIG. 5, another embodiment includes two tunnels 52 and 54, which run parallel to each other through the same ridge 32 between the channels 20. The two smaller tunnels 52 and 54 are of similar length and width. As with the single tunnel embodiments, the dimensions of the smaller tunnels 52 and 54 are determined by the footprint of the microphone 26. Each smaller tunnel 52 and 54 is approximately one half the width of the single tunnel 36 appropriate to the footprint of the microphone 26. The tunnels 52 and 54 perform essentially the same as the tunnel 36, but the smaller tunnel sizes further reduce the possibility of microphone abuse and large particle intrusion into the microphone.

Figure 6:
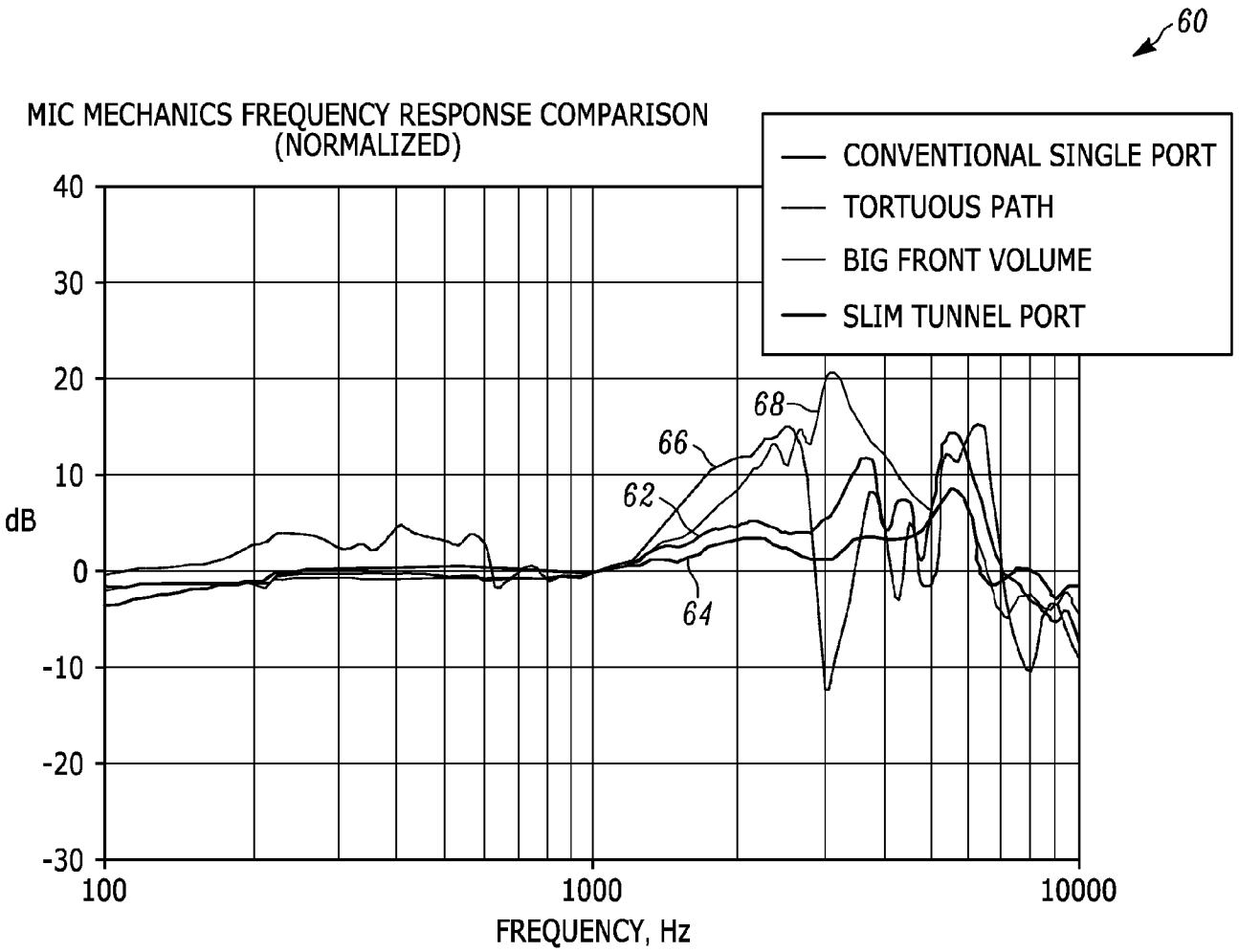
FIG. 6 is a chart comparing the frequency response of a slim-tunnel wind port to other conventional microphone ports.
Figure 7:
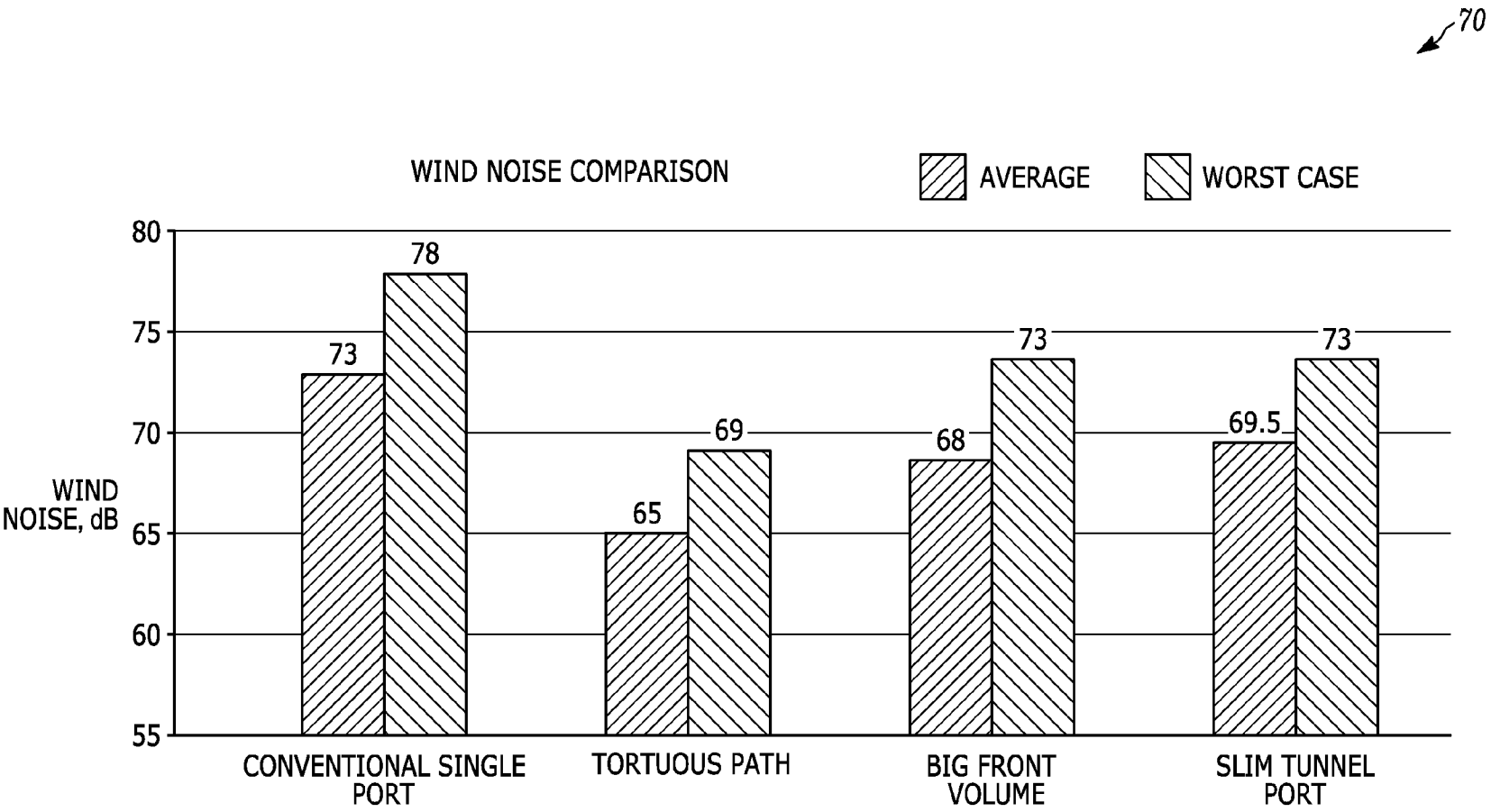
FIG. 7 is a chart comparing the wind noise performance of a slim-tunnel wind port to other conventional microphone ports.

FIGS. 6, 7, and 8 illustrate the performance of the microphone 26 when used in connection with an embodiment described herein, i.e., a slim-tunnel wind port, compared with the same microphone 26 used with other wind ports known in the art (for example, a conventional microphone port, a tortuous-path microphone port, and a big-front volume microphone port).

FIG. 6 is a chart 60 illustrating the frequency response of the microphone 26. The chart 60 illustrates the response in decibels (dB) of the microphone 26 over a range of frequencies. The measurements used to produce chart 60 were taken in accordance with International Electrotechnical Commission standard 60268-4 (available at https://webstore.iec.ch/publication/1221). To maximize speech intelligibility in voice transmissions, an even, or flat, frequency response in the voice band is desirable in a microphone used for radio communications. When a microphone produces an uneven frequency response, electronic equalization must be used to fine tune, i.e., flatten, the microphone signal. Microphones with frequency responses that are relatively flat within the voice band (approximately 300-3400 Hertz (Hz)) produce electrical signals that can be used as-is by radio communication devices. However, the signals from microphones with frequency responses that are not flat (greater than 6 decibels) in the voice band often require electronic equalization in order to be effectively used by a radio communication device. As indicated by line 62, the frequency response of the conventional microphone port is relatively flat (less than 6 decibels). As indicated by line 64, the frequency response of the slim-tunnel wind port is even flatter (less than 4 decibels). However, the frequency response of the tortuous path microphone port (line 66) and the big front volume microphone port (line 68) both exceed 6 decibels, and their signals require electronic equalization before they can be encoded and transmitted by a radio device.

FIG. 7 is a bar chart 70 illustrating the wind noise received by the microphone 26. The measurements used to produce bar chart 70 were taken in accordance with International Electrotechnical Commission standard 60268-4.

FIG. 8 is a table 80 comparing frequency response from FIG. 6, the wind noise performance from FIG. 7, and the space (in this case, measured in terms of depth) required to implement the wind ports. The data in table 80 indicates that the slim-tunnel port delivers better wind noise performance and better frequency response than the conventional microphone port using the same amount of space (depth) as the conventional microphone port. While the tortuous path and big front volume microphone port designs deliver slightly better wind noise performance, their frequency responses require equalization, and they take up two to five times the amount of space (depth) as the slim-tunnel wind port.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A housing for a communication device, the housing comprising:

a first channel;

a second channel;

a ridge between the first and second channels;

a tunnel extending through the ridge and connecting the first and second channels; and a microphone port beneath the ridge, the microphone port connected to the tunnel and configured to connect the tunnel to a microphone cavity in the housing;

wherein the housing is a single piece element, and wherein the first channel, the second channel, the ridge, and the tunnel are arranged to disrupt the formation of turbulence-causing discrete vortices by air moving across a surface of the housing.

2. The housing of claim 1, wherein the ridge has a longitudinal axis, and wherein the first and second channels are parallel to the longitudinal axis, and the tunnel is perpendicular to the longitudinal axis of the ridge.

3. The housing of claim 2, wherein each of the first and second channels is defined in part by a vertical planar side wall of the housing that has therein an opening forming an end of the tunnel, and wherein the vertical planar side wall also partially defines the ridge.

4. The housing of claim 3, wherein the ridge includes a planar horizontal surface which defines a top of the tunnel, and wherein each of the first and second channels is partially defined by a planar horizontal floor perpendicular to the side walls.

5. The housing of claim 4, wherein the opening in each of the side walls is rectangular.

6. The housing of claim 5, wherein the microphone port extends downward from a bottom of the tunnel toward the microphone cavity.

7. The housing of claim 6, wherein the tunnel has a tunnel length extending along a direction between the channels and a tunnel width extending along a direction perpendicular to the tunnel length and parallel to the two channels, and wherein the microphone port is rectangular in cross section and has a microphone port length substantially equal to the tunnel length and a microphone port width substantially equal to the tunnel width.

8. The housing of claim 1, further comprising:

a second tunnel extending through the ridge and connecting the first and second channels; and a second microphone port beneath the ridge, the second microphone port being connected to the second tunnel and configured to connect the second tunnel to the microphone cavity.

9. A communication device comprising:

a single piece element housing including a microphone cavity;

a first channel;

a second channel;

a ridge between the first and second channels;

a tunnel extending through the ridge and connecting the first and second channels;

a microphone port beneath the ridge, the microphone port connecting the tunnel to the microphone cavity; and a microphone in the microphone cavity;

wherein the first channel, the second channel, the ridge, and the tunnel are arranged to disrupt the formation of turbulence-causing discrete vortices by air moving across a surface of the single piece element housing.

10. The communication device of claim 9, wherein the ridge has a longitudinal axis, and wherein the first and second channels are parallel to the longitudinal axis, and the tunnel is perpendicular to the longitudinal axis of the ridge.

11. The communication device of claim 10, wherein each of the first and second channels is defined in part by a vertical planar side wall of the housing that has therein an opening forming an end of the tunnel, and wherein the vertical planar side wall also partially defines the ridge.

12. The communication device of claim 11, wherein the ridge includes a planar horizontal surface which defines a top of the tunnel, and wherein each of the first and second channels is partially defined by a planar horizontal floor perpendicular to the side walls.

13. The communication device of claim 12, wherein the opening in each of the side walls is rectangular.

14. The communication device of claim 13, wherein the microphone port extends downward from a bottom of the tunnel toward the microphone cavity.

15. The communication device of claim 14, wherein the tunnel has a tunnel length extending along a direction between the channels and a tunnel width extending along a direction perpendicular to the tunnel length and parallel to the two channels, and wherein the microphone port is rectangular in cross section and has a microphone port length substantially equal to the tunnel length and a microphone port width substantially equal to the tunnel width.

16. The communication device claim 9, wherein the housing further includes a second tunnel extending through the ridge and connecting the first and second channels; and a second microphone port beneath the ridge, the second microphone port being connected to the second tunnel and configured to connect the second tunnel to the microphone cavity.

17. The communication device of claim 9, further comprising a speaker inside the housing.

18. The communication device of claim 9, wherein the communication device includes a portable two-way radio.

19. A housing for a communication device, the housing comprising:

a first set of surfaces defining a first channel;

a second set of surfaces defining a second channel;

a ridge between the first and second channels; and a microphone port beneath the ridge, wherein the microphone port is connected to both of the first and second channels and extends downward from the first and second channels and is configured to connect the first and second channels to a microphone cavity in the housing, and wherein the housing is a single piece element, and wherein the first channel, the second channel, the ridge, and the microphone port are arranged to disrupt the formation of turbulence-causing discrete vortices by air moving across a surface of the housing.

20. The housing of claim 19, further comprising a tunnel extending through the ridge and connecting the first and second channels, and wherein the microphone port is connected to the tunnel.

* * * * *